US005827398A

United States Patent [19]

Depasquale et al.

[11] Patent Number: 5,827,398

[45] Date of Patent: Oct. 27, 1998

[54] PRODUCTION OF FILLED PAPER

[75] Inventors: David Depasquale, Nanaimo, Canada; Bruce Evans, Bethlehem, Pa.

[73] Assignees: Allied Colloids Limited, United Kingdom; Mineral Technologies, Inc., Bethlehem, Pa.

[21] Appl. No.: 600,336

[22] Filed: Feb. 13, 1996

[51] Int. Cl.[6] ..... D21H 21/10

[52] U.S. Cl. ..... 162/164.1; 162/164.3; 162/164.6; 162/168.1; 162/168.2; 162/168.3; 162/181.2; 162/181.6; 162/181.8; 162/183

[58] Field of Search ..... 162/168.2, 168.3, 162/175, 181.2, 183, 68.1, 181.6, 181.8, 181.1, 164.1, 164.3, 164.6

[56] References Cited

U.S. PATENT DOCUMENTS

| | | | |
|---|---|---|---|
| 4,610,801 | 9/1986 | Matthews et al. | 162/181.2 |
| 4,874,466 | 10/1989 | Savino | 162/164.3 |
| 5,026,457 | 6/1991 | Eichinger et al. | 162/158 |
| 5,126,010 | 6/1992 | Kobayashi et al. | 162/135 |
| 5,147,507 | 9/1992 | Gill | 162/158 |
| 5,216,014 | 6/1993 | Chung | 162/164.6 |

FOREIGN PATENT DOCUMENTS

| | | | |
|---|---|---|---|
| 0 281 134 | 9/1988 | European Pat. Off. | C09D 17/00 |
| 0 382 427 | 8/1990 | European Pat. Off. | C09D 17/00 |
| 0 608 986 | 8/1994 | European Pat. Off. | D21H 23/76 |
| 2 251 254 | 1/1992 | United Kingdom | D21H 17/69 |

*Primary Examiner*—Peter Chin

*Attorney, Agent, or Firm*—Sughrue, Mion, Zinn, Macpeak & Seas, PLLC

[57] ABSTRACT

Filled paper is made by adding a cationising amount of cationic polymer to a slurry of precipitated calcium carbonate, mixing this slurry into a cellulosic suspension and forming a thin stock, adding anionic particulate material to the suspension before or after the slurry, mixing a polymeric retention aid into the thin stock which includes the precipitated calcium carbonate and the anionic particulate material, draining the thin stock on a screen to form a sheet and drying the sheet. A suitable slurry for this purpose is a slurry of 5 to 70% by weight precipitated calcium carbonate and cationic polymer selected from 0.1 to 1% cationic starch and 0.01 to 0.3% of a high charge density, relatively low molecular weight, cationic polymer.

13 Claims, No Drawings

PRODUCTION OF FILLED PAPER

FIELD OF THE INVENTION

This invention relates broadly to the manufacture of filled paper and to filler compositions for use in this. More particularly, the invention relates to the manufacture of paper filled with precipitated calcium carbonate (PCC) and slurries of PCC.

BACKGROUND OF THE INVENTION

It is standard practice to make filled paper by mixing filler with a cellulosic suspension and forming a thin stock, mixing a polymeric retention aid into the thin stock, draining the thin stock on a screen to form a sheet and drying the sheet.

The quality of the resultant paper depends in part on the nature of the initial cellulosic suspension and the amount and nature of filler and other additives. Fine papers may be highly filled and sized and formed from a relatively pure suspension. Other paper, such as newsprint, is made from cellulosic suspension which is frequently referred to as being "dirty" or as containing "anionic trash". Typical of such suspensions are those which contain a significant proportion of groundwood or other mechanically derived pulp, or de-inked pulp or broke.

Originally paper such as newsprint was generally substantially unfilled while fine paper was filled, but there is now a demand f or papers such as newsprint to include some filler.

The purpose of the polymeric retention aid is to promote the retention of paper fines, and filler if present. A single polymer, or a combination of materials may be used, and the nature of the retention system has to be selected according to the nature of the suspension in order to obtain optimum results. It is desirable to achieve the maximum possible retention of filler, irrespective of the nature of the filler.

There are some proposals in the literature suggesting particular ways of improving retention of some fillers by treatment with, for instance, a relatively low molecular weight cationic polymer prior to the addition of polymeric retention aid into the thin stock.

For instance in EP-A-608,986 it is proposed to coagulate filler in a thick stock feed suspension by adding cationic coagulant to the feed suspension and forming thin stock from this, adding bentonite to the thin stock or to the thick stock before it is converted to the thin stock, subsequently adding polymeric retention aid to the thin stock and forming paper from the thin stock. The process is intended mainly for dirty suspensions. Fillers which are mentioned are china clay, calcium carbonate and kaolin. However all the experimental data relates to the use of calcined clay and shows that treatment of the calcined clay with cationic coagulant before addition to the thick stock is much less effective than adding the coagulant to a preformed mixture of the cellulosic suspension and clay. In fact, the data shows that retention of the clay is not improved by pretreatment of the clay with the cationic coagulant.

U.S. Pat. No. 4,874,466, U.S. Pat. No. 5,126,010, U.S. Pat. No. 5,126,014 and GB 2,251,254 are other disclosures of processes in which cationic coagulant is added with the intention of improving retention of filler.

It can be difficult to achieve good retention of PCC, and a particular problem is that the retention properties are liable to vary somewhat unpredictably, for instance from one manufacturing plant to another. Accordingly there is an urgent need to achieve reasonably consistent and good retention of PCC. The problem of poor and/or variable PCC retention is particularly significant when using "dirty" cellulosic suspensions.

PCC is generally made at the paper mill by injecting carbon dioxide into an aqueous lime solution to form a slurry typically having a PCC content typically of 13–20%.

It has already been proposed that it can be desirable to provide a cationic surface charge to aid retention of PCC and other fillers, see for instance the abstract of Tappi 1990 Neutral/Alkaline Papermaking, Tappi Short Course Notes, pages 92 to 97 by Gill, in which the author states that the zeta potential of a filler is important to retention. Other disclosures about the retention of filler are in the references listed in that paper.

In U.S. Pat. No. 5,147,507 Gill is concerned with the manufacture of sized paper from a clean pulp. He describes treating PCC with a ketene dimer size which has been made cationic by treating the dimer with a polyamino-amide or a polyamine polymer reacted with an epoxinised halohydrin compound. The use of 0.25 to 2% of this cationic polymeric size material is said to produce a filler having a reduced sizing demand. It is also shown to achieve a small improvement in the filler retention. For instance it is shown in one fine paper example that filler retention can be increased from 72% to 77.4% by the described treatment of PCC.

PCC retention in the dirty pulps with which we are concerned is always very much less, and is frequently in the range 0% to 15%. The resultant paper is usually unsized. Pretreatment with a cationic polymer can increase retention but the value is still unacceptably low.

OBJECT OF THE INVENTION

One object of the invention is to provide a paper-making process which utilises PCC and which can give significantly improved retention of PCC.

Another object is to achieve this when the cellulosic suspension is a groundwood or other "dirty" suspension.

Another object of the invention is to achieve this when the paper is a material such as newsprint, supercalendered, mechanically finished, mechanically finished coated or lightweight coated paper, wherein the paper is typically unsized.

Another object is to make paper which is filled with PCC and which has improved properties, for instance as regards formation and linting.

Another object of the invention is to provide PCC slurries capable of giving good retention.

SUMMARY OF THE INVENTION

Filled paper is made by forming a PCC-containing thin stock by a process comprising mixing a slurry of PCC with a cellulosic suspension, mixing polymeric retention aid into the PCC-containing thin stock, draining the thin stock on a screen to form a sheet and drying the sheet. In this process a cationising amount of water soluble cationic polymer is added into the slurry of PCC before the slurry is mixed with the cellulosic suspension, and anionic microparticulate material is added to the cellulosic suspension before the addition of the polymeric retention aid.

Thus in the invention, the cationised PCC slurry is added to the cellulosic suspension, bentonite or other anionic microparticulate material is added to the suspension before or after adding the cationised PCC, and polymeric retention aid is thereafter added in conventional manner to thin stock containing the PCC and bentonite or other anionic microparticulate material.

We have found that the described combination of cationising the PCC before mixing it with the cellulosic suspension and adding the bentonite or other anionic microparticulate material before adding the polymeric retention aid gives unexpectedly large, and very valuable, improvement in PCC retention, especially in dirty suspensions. This surprising result is opposite to what would be expected if PCC performed in a similar manner to the clay used in the Examples of EP-A-608986. The large improvement in retention is in contrast to the small improvement shown for a sized, fine, paper in U.S. Pat. No. 5,147,507.

The invention also provides a PCC slurry suitable for use in this process. The preferred slurry is an unsized slurry of PCC (typically about 10 to 70%, preferably 10–40%, by weight PCC) and cationic polymer which can be a small amount (typically about 0.01 to 0.3%) of a synthetic cationic polymer which has a high charge density (typically above about 4 meq/g) and low intrinsic viscosity (typically below about 3 dl/g) but can be a larger amount (typically up to about 1%) of a cationic starch.

DESCRIPTION OF PREFERRED EMBODIMENTS

The PCC slurry is preferably substantially free of size. The preferred slurries are unsized and contain 10 to 70% by weight precipitated calcium carbonate and also containing cationic polymer selected from (a) about 0.1 to 1% cationic starch and (b) about 0.01 to 0.2% of a synthetic cationic polymer which has a cationic charge density of at least 4 meq/g and intrinsic viscosity of below about 3 dl/g, wherein the percentages are dry weight polymer based on the dry weight of PCC.

The precipitated calcium carbonate which is used in the invention can be made by any of the known techniques for the manufacture of PCC. Such techniques usually involve passing carbon dioxide through an aqueous solution of slaked lime, calcium oxide, to form an aqueous slurry of precipitated calcium carbonate. The slurry generally has a PCC content of at least about 5% and usually at least about 10%. Usually the PCC content is not more than about 70%, often is below 40% and usually it is below about 30%. A PCC content of around 20% (eg 15–25%) is typical. Dispersants and other conventional additives may be included in the slurry to promote stability, in conventional manner.

The crystal structure of the slurry is usually scalenohedral or rhombohedral but other precipitated calcium carbonates suitable for paper filling grades may be used. Variations in the quality of the water and the method of manufacture and other process conditions can influence the crystal structure and the performance and properties of the PCC in known manner, for instance to vary capacity, brightness or gloss.

The PCC slurry may have been treated in known manner to render it acid tolerant, for instance as described in U.S. Pat. No. 5,043,017 and 5,156,719. The PCC slurry which is used in paper making preferably is substantially the slurry formed initially by the precipitation process, without any intervening drying and reslurrying stage. However if desired it is possible to recover PCC from a slurry as powder and then reslurry it prior to use in paper making.

The average particle size (50% PSD) of the PCC particles in the slurry is usually within the range about 0.25 $\mu$m to 3 $\mu$m.

The invention is of particular value when applied to PCC grades which give particularly poor retention in the particular furnish which is being used. For instance the combination of pulp and the PCC is preferably such that the first pass PCC retention (as measured by a Britt Dynamic Drainage Retention Jar) would be 0–20%, often 0–15% in the absence of the cationic pretreatment and the anionic microparticulate treatment but is raised by at least 15 points, often 25–60 points, by the invention to a value of at least 35% and usually 50–70% or more.

The cellulosic suspension can be formed from any suitable source of cellulosic fibres. It can be formed by dispersing dried pulp but the invention is of particular value when applied to processes where the suspension is made and used in an integrated pulp and paper mill.

Although the invention can be used on a variety of cellulosic suspensions, the suspension is preferably one that would be classified as being a relatively "dirty" suspension or as a suspension containing significant amounts of "anionic trash".

The preferred suspensions are suspensions which contain a significant amount, usually at least 30% by weight and preferably at least 50% by weight (based on the dry weight of the cellulosic feed to the suspension) selected from one or more mechanically derived pulps including thermomechanical pulp, chemimechanical pulp, and groundwood pulp, including recycled paper formed from such pulps. Other dirty pulps include pulps containing coated broke and deinked pulps and peroxide-bleached chemical and mechanical pulps. The paper-making process generally includes prolonged recycling of white water, and this also can contribute to the suspension being "dirty".

One analytical technique for indicating preferred "dirty" suspensions is by measuring conductivity, since such suspensions tend to contain ionic trash and other electrolyte. This electrolyte may originate from the initial groundwood (such as lignin compounds, extractives and hemi-celluloses) or from other sources, such as the gradual buildup of alkaline and alkaline earth metals dissolved from the suspension and recycled in white water. The dirty suspension can be such that white water (i.e., the water drained through the screen when the filled suspension containing retention aid is drained to make a sheet) has conductivity of above about 1,000, and preferably above about 1,500 micro siemens, often 2,000 to 3,000 micro siemens or more. Conductivity of the white water can be determined by conventional conductivity-measuring techniques.

The anionic trash component of suitable suspensions is usually such that a relatively large amount of cationic polymer has to be added to the suspension (in the absence of PCC or other filler or retention aid additions) in order to achieve significant retention of the fibres. This is the "cationic demand". Preferably the cationic demand of the thin stock (in the absence of any of the additions defined in the invention, namely filler, cationic polymer, polymeric retention aid and inorganic anionic polymeric material) is such that it is necessary to add at least about 0.06%, and often at least about 0.1%, by weight of polyethylene imine (600 or 1,000 g/t) in order to obtain a significant improvement in retention.

Another way of indicating a dirty suspension of the type preferred for use in the invention is to filter a sample of the thin stock (without any of the additions) through a fast filter paper and titrate the filtrate against a standardised solution of poly diallyl dimethyl ammonium chloride, for instance using a Mutek particle charge detector. The concentration of anionic charge in the filtrate is then usually above 0.01, and often above 0.05 or 0.1, millimoles per liter.

The pH of the suspension can be conventional. thus it can be substantially neutral or alkaline, but if the PCC has been treated to render it acid tolerant then the pH can be acidic, for instance 4 to 7, often around 6–7.

The papers that are made by the invention are those which are conventionally made from relatively dirty suspensions. The invention is of particular value to the production of newsprint and machine-finished (MF) grades but is also of value for super calendered papers, and machine-finished coated papers, and also for lightweight-coated papers and speciality groundwoods. The paper can be of any conventional weight, and so can be board, including bleached board.

PCC is preferably substantially the only filler and so may be the only filler that is deliberately added, although other filler may be included, for instance as a result of incorporation of recycled paper in the suspension or as a result of deliberate addition of filler such as anhydrous or calcined clays or speciality pigments. The amount of PCC, and the total amount of filler, in the suspension that is drained is generally at least 3% or 5% (dry weight filler based on dry weight of suspension) and usually at least 10%. It can be up to 45% or even 60% in some instances but is usually below 30%. The amount of filler in the paper is generally in the range 1% to 20% or 30% (dry weight filler based on dry weight paper). The PCC is often 50 to 100% of the total filler content of the suspension and the paper.

The invention is of particular value in the production of newsprint typically containing above 1% to 10% filler, super calendered and machine-finished papers typically containing about 5 to 40% filler, and lightweight coated papers typically containing about 2 to 10% by weight filler.

The cellulosic suspension used in the invention is generally made by initially providing a thick stock and then diluting this to a thin stock, in conventional manner. The thick stock generally has a total solids content in the range about 2.5 to 10%, often around 3 to 6%, and the thin stock usually has a total solids content in the range about 0.25 to 2%, often around 0.5 to 1.5% by weight.

The slurry of PCC can be incorporated in the suspension while in the form of a thin stock, or the slurry can be incorporated while the suspension is in the form of a thick stock, and the thick stock can be diluted to a thin stock simultaneously with or after mixing the slurry of PCC into the suspension. Preferably the slurry of PCC is added into a thin stock suspension.

Before mixing the PCC slurry with the suspension it is necessary to mix into the PCC slurry a cationising amount of a cationic polymer. The amount that is used must be sufficient to render the PCC in the slurry sufficiently cationic to achieve significantly improved retention in the process compared to the retention obtained if the same process is conducted in the absence of the cationic polymer. The amount which is selected is usually the amount which gives optimum retention. A suitable amount can be found by routine experimentation in that Britt Jar or other routine laboratory tests can be conducted at varying levels of addition so as to determine which is the optimum.

The amount is generally in the range about 0.005% to 2%, dry weight polymer based on the dry weight of PCC in the slurry.

The cationic polymer can be a cationic naturally-occurring polymer, such as cationic starch. With a modified natural polymer such as this, the amount is usually at least 0.05% and is usually in the range 0.1 to 1%, often around 0.3 to 0.7%. Routine testing of a range of cationic starches will allow selection of grades (degree of substitution and origin of starch) which are suitable. Potato or other relatively low molecular weight starches are preferred. Low DS starches are preferred.

When a synthetic cationic polymer is used, it is preferred that it should have a relatively low molecular weight and a high charge density, in which event suitable amounts are generally in the range about 0.005 to 0.2%, often around about 0.01 to 0.1%.

The synthetic polymer generally has intrinsic viscosity below about 3 dl/g. Intrinsic viscosity (IV) is measured by a suspended level viscometer at 25° C. in one molar sodium chloride buffered to pH7. It can be below 1 dl/g but it is often preferable for it to be above 1 dl/g e.g., 1.5 to 2.5 dl/g or more. Some suitable polymers have IV below 1 dl/g and some have such low molecular weight that it may not be appropriate to determine it as IV, but if IV is measurable then the value is usually at least about 0.1 or 0.2 dl/g. If the molecular weight is measured by gel permeation chromatography, the value is usually below 2 or 3 million, often below 1 million. It is usually above 100,000 and can be as low as, for instance, about 10,000 for some polymers such as dicyandiamides.

The synthetic polymer generally has a relatively high cationic charge density of at least 2 meq/g and often at least 4 meq/g, for instance 6 meq/g or more.

The cationic polymer should be used in its conventional, free polymer, form and should not be completed or otherwise associated with a diluent which would undesirably reduce the cationic charge or increase the molecular weight of the cationic polymer that is added to the PCC. In particular the polymer must not be complexed with a sizing component as in U.S. Pat. No. 5,147,507 since the sizing component undesirably reduces the effectiveness of the polymer for treating the PCC.

The synthetic polymer can be a polyethylene imine, a dicyandiamide or a polyamine (e.g., made by condensation of epichlorhydrin with an amine) but is preferably a polymer of an ethylenically unsaturated cationic monomer, optionally copolymerised with one or more other ethylenically unsaturated monomers, generally non-ionic monomers. Suitable cationic monomers are dialkyl diallyl quaternary monomers (especially diallyl dimethyl ammonium chloride, DADMAC) and dialkylaminoalkyl -(meth) acrylamides and -(meth) acrylates usually as acid addition or quaternary ammonium salts.

Preferred cationic polymers are polymers of diallyl dimethyl ammonium chloride or quaternised dimethylaminoethyl acrylate or methacrylate, either as homopolymers or copolymers with acrylamide. Generally the copolymer is formed of 50 to 100%, often 80 to 100%, cationic monomer with the balance being acrylamide or other water soluble non-ionic ethylenically unsaturated monomer. DADMAC homopolymers and copolymers with 0–30% by weight acrylamide, generally having IV from 1 to 3 dl/g, are preferred. It is also possible in the invention to use, for pretreating the PCC, a cationic polymer having IV above 3 dl/g. For instance copolymers of acrylamide and DADMAC (or other cationic ethylenically unsaturated monomer) having IV up to 6 or 7 dl/g are sometimes suitable.

If desired, the slurry of PCC may contain a mixture of the cationic polymers, for instance a mixture of cationic starch and a low molecular weight, high charge density, synthetic cationic polymer. Naturally the cationic polymer should be water soluble at the concentrations at which it is used.

The cationic polymer can be mixed by batch or in-line addition into the PCC as it is being pumped towards the point where it is added to the cellulosic suspension, or it can be mixed into the PCC in a storage vessel. Sufficient mixing must be applied to distribute the polymer substantially uniformly over the PCC before addition to the cellulosic suspension. The cationic polymer can be provided as an aqueous solution which is mixed with the filler, or a powdered or reverse phase form of the cationic polymer may be used.

In the invention, there should be interaction, in the cellulosic suspension, between the cationised PCC and anionic microparticulate material before adding polymeric retention aid. The microparticulate material can be included in the suspension before adding the PCC slurry. For instance the microparticulate material can be mixed into thin stock before adding the PCC slurry or it can be mixed into thick stock at some earlier stage, generally just before adding the PCC slurry. Preferably the microparticulate material is added to the thin stock just after adding the PCC slurry.

The anionic microparticulate material is usually inorganic. It can be a colloidal silica or other synthetic microparticulate silica material such as polysilicic acid or a synthetic polyalumino silicate, but is preferably an inorganic swelling clay of the type usually referred to colloquially as a bentonite. Usually it is a smectite or montmorillonite or hectorite. The materials commercially available under names such as bentonite and Fullers Earth are suitable. Zeolites can be used provided their particle size is sufficiently small. It should be below 3 $\mu$m and preferably below 0.3 $\mu$m or even 0.1 $\mu$m.

Instead of using inorganic anionic microparticulate material it is also possible to use organic microparticulate material, for instance an emulsion of relatively water-insoluble anionic polymer particles in water or in a non-aqueous liquid. For instance the anionic polymer particles can be of cross-linked water-swellable anionic polymer or can be of linear or cross-linked water insoluble polymer. Again the particle size should be very small and can be below 0.3 or 0.1 $\mu$m.

The amount of anionic microparticulate material that is added will depend upon the materials being used but can be selected by routine experimentation to give suitable results. Generally it is in the range about 0.05 to 1%, often about 0.1 to 0.5% (ie 1 to 5 kg/t dry weight of suspension).

It is known that it can be desirable to use, as a retention system for dirty suspensions, a material such as bentonite followed by a substantially non-ionic polymer. In the invention, we surprisingly find that pretreating the PCC with the cationic polymer can have the effect of reducing (by as much as 50%) the amount of anionic particulate material which is required to achieve optimum retention.

After providing the thin stock containing the cationised PCC and the bentonite or other anionic microparticulate material (either by direct additions into the thick stock or by dilution of a thick stock) the thin stock may be subjected to conventional papermaking procedures. In particular a polymeric retention aid is added to the thin stock. The retention aid can be non-ionic, in which event it can be polyethylene oxide having a molecular weight above 2 million and usually about 4 to 8 million, or it can be a water soluble addition polymer of an ethylenically unsaturated monomer or monomer blend which can be non-ionic, anionic or cationic. Generally the retention aid is a synthetic polymer having intrinsic viscosity above 4 dl/g and often above 6 dl/g.

It is well established that in conventional paper-making processes, it is often desirable to use a retention aid having as high an intrinsic viscosity as possible so that it is often considered that, for instance, a polymer having IV 9 will perform better than a polymer formed from the same monomer blend but with IV 7. Surprisingly, in the invention, we find that improved performance can often be achieved using lower molecular weight retention aids. In particular improved paper formation can be achieved while obtaining good retention. Accordingly it can be preferred in the invention that the polymer has IV not more than 8 dl/g. However if desired a very high molecular weight polymer can be used, for instance having IV up to 12 dl/g, 15 dl/g or even higher.

The monomer or monomer blend used for forming the retention aid can be non-ionic or it can be anionic or cationic. If it is ionic the amount of ionic monomer can be up to, for instance about 50 weight percent of the blend but preferably the amount of ionic monomer is relatively low. Thus preferably the polymer is a polymer formed from at least about 60 or 70 mole percent, and often at least about 80 or 90 mole percent non-ionic monomer with any balance being ionic monomer. For instance the polymer can contain up to about 15 mole percent, usually only up to about 10 mole percent ionic groups and generally can contain up to about 5 mole percent cationic groups and/or up to about 8 mole percent anionic groups. Preferred polymers are formed of 90–100% by weight acrylamide and 0–10% sodium acrylate.

The preferred non-ionic monomer is acrylamide and so a preferred non-ionic polymer is polyacrylamide homopolymer (which may be contaminated with up to about 1 or 2% sodium acrylate). Suitable anionic monomers are ethylenically unsaturated carboxylic or sulphonic monomers, usually ethylenically unsaturated carboxylic monomers such as sodium acrylate or other suitable alkali metal salt of such a monomer. Suitable cationic monomers are dialkylaminoalkyl (meth) -acrylates and -acrylamides, generally as acid addition or quaternary ammonium salts. Preferred cationic monomers are dialkylaminoethyl (meth) acrylate acid addition or quaternary salts, usually dimethylaminoethyl acrylate quaternary salt.

Preferably the retention aid is selected from polyethylene oxide and polymers of non-ionic ethylenically unsaturated monomer with up to 50 weight % ionic ethylenically unsaturated monomer and having intrinsic viscosity above about 4 dl/g., and most preferably is selected from polymers which have intrinsic viscosity above about 4 dl/g and which are formed from acrylamide with about 0 to 8 mole % ethylenically unsaturated carboxylic monomer and about 0 to 5 mole % ethylenically unsaturated cationic monomer.

The amount of polymeric retention aid that is required can be found by routine experimentation and is usually in the range about 0.005% to 1% (dry weight polymer based on dry weight feedstock, 0.05 to 10 kg/ton), often around about 0.01 to 0.1%.

If desired, bentonite or other inorganic anionic particulate material may additionally be added to the suspension after adding the polymeric retention aid, but generally no such addition is made. Thus the polymeric retention aid is preferably added during or after the last point of high shear, for instance at the head box.

The suspension may be drained through a screen and the resultant wet sheet dried and subject to conventional post-treatments such as calendering in conventional manner.

The paper can be subjected to external or internal sizing although the paper is usually substantially unsized cellulosic suspension and there is substantially no external sizing. Thus preferably no ketene dimer or other internal size is included deliberately in the cellulosic suspension although it is permissible for small amounts of size to be introduced into the suspension as a result of recycling waste paper.

The process of the invention can give a very large improvement in retention, as discussed above. The process can result in a valuable reduction in dusting or linting. The process can result in an improvement in paper quality.

The following are examples of the invention.

EXAMPLE 1

A cellulosic thin stock having a dry content of 1% was formed from a 0.8% cellulosic suspension based mainly on chemi-thermomechanical pulp and 0.2% (based on the suspension) of an acid tolerant PCC slurry giving a filler content in the suspension of 0.3%.

In some tests the PCC slurry was pretreated with cationic polymer.

In some tests bentonite was added to the thin stock before or after the addition of PCC.

All the tests were conducted on a Britt Jar and the suspension was drained through a screen under agitation to form a wet sheet, and the first pass PCC retention was recorded.

The results are summarised in the following table in which dosages of the cationising polymer for PCC are expressed as kilograms dry weight of polymer per tonne dry weight of PCC, while dosages of the retention aid and anionic particulate material (bentonite) are expressed as kilograms dry weight per tonne dry weight of cellulosic suspension. The following abbreviations are used:

B-bentonite

C-polydiallyldimethyl ammonium chloride molecular weight below 500,000 and cationic charge density of about 6 meq/g D-cationic starch available from Staley Corporation under the trade name Stalok 410

E-non-ionic polyacrylamide intrinsic viscosity about 14 dl/g

TABLE 1

| Experiment | Cationising Polymer on PCC | Addition order and amounts | % First Pass PCC Retention |
|---|---|---|---|
| 1 | — | PCC/0.5E | 15 |
| 2 | 0.6C | PCC/0.5E | 34 |
| 3 | — | 3.6B/PCC/0.5E | 38 |
| 4 | — | 1.8C/3.6B/PCC/0.5E | 33 |
| 5 | 0.6C | 3.6B/PCC/0.5E | 60 |
| 6 | 4.5D | PCC/0.5E | 37 |
| 7 | — | 6.8D/3.6B/PCC/0.5E | 44 |
| 8 | 4.5D | 3.6B/PCC/0.5E | 62 |
| 9 | 4.5D | 1.0B/PCC/0.5E | 54 |
| 10 | 4.5D | 1.8B/PCC/0.5E | 61 |

When experiments 3 and 5 were repeated using a different source of PCC the results that were obtained were, respectively, 45% and 60%, confirming that the invention allows equivalent results to be obtained by the cationised PCC even though the uncationised PCC may give different results.

Comparison of 5 with 1 to 4 shows the dramatic improvement in retention that is attainable by the invention. Comparison of 4 and 5 shows that it is the pre-treatment of the PCC, rather than the mere presence of the cationic polymer, which is necessary in order to achieve this improvement.

Comparison of 6, 7 and 8 shows similar trends when the pre-cationisation is achieved using a larger amount of cationic starch. 9 and 10 show that good results can be achieved even when the amount of bentonite is significantly decreased.

EXAMPLE 2

First pass PCC retention data was determined broadly as in Example 1 in processes in which acid tolerant PCC (usually after treatment with 0.05% cationic polymer) was mixed into a thin stock under agitation followed by the addition of retention system A or retention system B. System A consisted of the addition of 8 ppt bentonite followed by 1 ppt non-ionic polyacrylamide IV about 14 dl/g, while system B consisted of 8 ppt bentonite followed by 1 ppt cationic polyacrylamide having IV about 11 dl/g and formed from 95% by weight acrylamide and 5% by weight quaternised dimethylaminoethyl acrylate.

The following results were obtained:

TABLE 2

| Experiment Number | Polymer | System A | System B |
|---|---|---|---|
| 1 | None | 3 | 6 |
| 2 | 75% DADMAC 25% Acrylamide | 31 | |
| 3 | 50% DADMAC 50% Acrylamide | 28 | |
| 4 | 25% DADMAC 75% Acrylamide IV about 6 | 30 | |
| 5 | Polyethyleneimine | 28 | 18 |
| 6 | Polyamine molecular weight below 200,000 | 22 | 14 |
| 7 | PolyDADMAC molecular weight below 500,000 | 31 | 25 |
| 8 | PolyDADMAC IV 1 to 1.5 | 38 | 29 |
| 9 | PolyDADMAC IV 1.5 to 2 | 39 | 34 |

It is apparent from this data that increasing the IV of the cationic polymer above IV 1 dl/g, for instance into the range IV 1.5 to 3 dl/g, is advantageous.

We claim:

1. A process for making filled paper comprising forming a thin stock which contains precipitated calcium carbonate (PCC) by a process comprising mixing a slurry of PCC with a cellulosic suspension, mixing polymeric retention aid into the thin stock which includes the PCC, the retention aid having intrinsic viscosity above 4 dl/g and being selected from the group consisting of polyethylene oxide having molecular weight above 2 million and water soluble addition polymers of non-ionic, anionic or cationic ethylenically unsaturated monomer or monomer blend, draining the thin stock on a screen to form a sheet and drying the sheet, wherein a cationising amount of a water-soluble cationic polymer is added into the slurry of PCC before the slurry is mixed with the cellulosic suspension, the cationic polymer being selected from the group consisting of: (i) cationic naturally occurring polymers and; (ii) cationic synthetic polymers having intrinsic viscosity below about 3 dl/g and a cationic charge density of at least 2 meq/g, said cationic synthetic polymers being selected from the group consisting of polyethylene imine, dicyandiamides, polyamines and polymers of 50 to 100% ethylenically unsaturated cationic monomer and 0 to 50% non-ionic ethylenically unsaturated monomer, and anionic microparticulate material, the microparticulate material being selected from the group consisting of an anionic emulsion of water insoluble anionic polymeric microparticles, microparticulate silica material and inorganic swelling clay, is added to the cellulosic suspension before the addition of the polymeric retention aid.

2. A process according to claim 1 in which the cellulosic suspension is a suspension formed from at least 30% of a cellulosic pulp selected from mechanically derived pulp, coated broke pulp and de-inked pulp and peroxide bleached chemical and mechanical pulps.

3. A process according to claim 1 in which the suspension gives a white water having conductivity at least about 1500 micro siemens.

4. A process according to claim 1 in which the paper is selected from newsprint, supercalendered grades, machine finished grades, machine finished coated grades, lightweight coated grades, bleached board, and speciality groundwoods.

5. A process according to claim 1 in which the polymeric retention aid is selected from polyethylene oxide and polymers of non-ionic ethylenically unsaturated monomer with up to 50 weight % ionic ethylenically unsaturated monomer and having intrinsic viscosity above about 4 dl/g.

6. A process according to claim 1 in which the polymeric retention aid is selected from polymers which have intrinsic viscosity above about 4 dl/g and which are formed from acrylamide with about 0 to 8 mole % ethylenically unsaturated carboxylic monomer and about 0 to 5 mole % ethylenically unsaturated cationic monomer.

7. A process according to claim 1 in which the cationic polymer is selected from about 0.05 to 1% cationic starch and about 0.005 to 0.2% of a synthetic cationic polymer which has a cationic charge density of at least about 4 meq/g and intrinsic viscosity of below about 3 dl/g.

8. A process according to claim 1 in which the cationic polymer is selected from cationic starch, polyethylene imines, dicyandiamides, polyamines and polymers of dialkylaminoalkyl (meth) - acrylate or -acrylamide and polymers of diallyl quaternary monomers.

9. A process according to claim 1 in which the cationic polymer is a polymer of diallyldimethyl ammonium chloride optionally copolymerised with acrylamide.

10. A process according to claim 1 in which the anionic particulate material is selected from swelling clays, zeolites and synthetic particulate silica compounds.

11. A process according to claim 1 in which the anionic particulate material is a bentonite.

12. A process according to claim 1 in which the PCC is substantially the only filler and the total amount of filler in the suspension is from about 3 to 60% by weight.

13. A process according to claim 1 in which the retention aid is a water-soluble polymer which has intrinsic viscosity above 4 dl/g and below 8 dl/g.

* * * * *